US008577233B2

(12) United States Patent
Schneider et al.

(10) Patent No.: US 8,577,233 B2
(45) Date of Patent: Nov. 5, 2013

(54) SYSTEM AND METHOD FOR SELECTING COLOR TABLES FOR A COLOR PRINTER

(75) Inventors: Eric S. Schneider, Boise, ID (US); George B. Clifton, Boise, ID (US); Ben Tyson, Eagle, ID (US); Gustavo M. Guillemin, Jalisco (MX); Quintin T. Phillips, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 446 days.

(21) Appl. No.: 12/935,409

(22) PCT Filed: Apr. 10, 2008

(86) PCT No.: PCT/US2008/059835

§ 371 (c)(1),
(2), (4) Date: Sep. 29, 2010

(87) PCT Pub. No.: WO2009/126156

PCT Pub. Date: Oct. 15, 2009

(65) Prior Publication Data

US 2011/0020019 A1 Jan. 27, 2011

(51) Int. Cl.
*G03G 15/01* (2006.01)

(52) U.S. Cl.
USPC ..... 399/39

(58) Field of Classification Search
USPC ..... 399/39, 40, 67–70
See application file for complete search history.

(56) References Cited

U.S. PATENT DOCUMENTS

| | | | | |
|---|---|---|---|---|
| 4,937,600 | A * | 6/1990 | Hirabayashi et al. | |
| 5,103,260 | A | 4/1992 | Tompkins et al. | |
| 5,191,375 | A * | 3/1993 | Hamilton | 399/68 |
| 6,243,545 | B1 | 6/2001 | Jewell | |
| 6,393,233 | B1 | 5/2002 | Soulier | |
| 6,542,703 | B1 | 4/2003 | Jung | |
| 6,603,574 | B1 | 8/2003 | Ramirez et al. | |
| 6,710,309 | B1 | 3/2004 | Hirst | |
| 7,088,931 | B2 | 8/2006 | Kojima | |
| 7,106,984 | B2 | 9/2006 | Katsumi | |
| 7,206,532 | B2 | 4/2007 | Lofthus et al. | |
| 7,286,780 | B2 | 10/2007 | Yonekawa | |
| 2008/0075495 | A1 * | 3/2008 | Oyumi | |

FOREIGN PATENT DOCUMENTS

| | | | |
|---|---|---|---|
| JP | 63126770 | A | 5/1988 |
| JP | 06075503 | A * | 3/1994 |
| JP | 2005018060 | A | 1/2005 |
| KR | 20060040032 | A | 5/2006 |

* cited by examiner

*Primary Examiner* — David Gray
*Assistant Examiner* — Milton Gonzalez

(57) ABSTRACT

A method for color printing includes the steps of determining a voltage level of electrical power supplied to an electrophotographic printing device having multiple colors of toner, the voltage level defining a fusing capacity, and selecting a color table, stored in memory, defining a maximum toner application level for each color of toner, based upon the fusing capacity.

20 Claims, 4 Drawing Sheets

50

| VOLTAGE | COLOR TABLE INK LEVEL | RGB (input) | CMYK (output) |
|---|---|---|---|
| LOW | Low (140%) | 1, 0, 0 | 0, .7, .7, 0 |
| | | 0, 1, 0 | .7, 0, .7, 0 |
| | | 0, 0, 1 | .7, .7, 0, 0 |
| | | 1, 0, 0 | 0, .65, .65, .1 |
| MID | Mid (170%) | 1, 0, 0 | 0, .85, .85, 0 |
| | | 0, 1, 0 | .85, 0, .85, 0 |
| | | 0, 0, 1 | .85, .85, 0, 0 |
| | | 0, 1, 0 | .8, 0, .8, .1 |
| HIGH | High (200%) | 1, 0, 0 | 0, 1, 1, 0 |
| | | 0, 1, 0 | 1, 0, 1, 0 |
| | | 0, 0, 1 | 1, 1, 0, 0 |
| | | 0, 0, 1 | .95, .95, 0, .1 |

52

Increasing Saturation/ Image Quality

FIG. 5

SYSTEM AND METHOD FOR SELECTING COLOR TABLES FOR A COLOR PRINTER

BACKGROUND

The present disclosure relates generally to color laser printing. In electrophotographic printers, the temperature of the fuser roller has a significant effect on image quality. Higher toner coverage is generally desirable for higher quality printing, including color printing. When printing documents, especially with high toner coverage and full color, the capacity of the fuser may be the limiting factor for the amount of toner that can be used. Too much toner, and/or a higher maximum toner level can result in incomplete fusing or paper jams. However, if the fuser is too hot for the amount of toner, paper offsets or jams can be the result.

The quality of a printed image is related to the line voltage provided to the printing unit because the line voltage is a direct limiter of fuser heat capacity, and thereby fusing capability. Line voltage can vary from place to place and from time to time. For example, in Japan 100v is common, while in the US 110v is standard. Additionally, the voltage level in a given place can fluctuate from the nominal voltage over time, due to changing supply and demand within the power distribution system. These factors tend to cause variations in print quality and printer performance.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein:

FIG. 5 is an exemplary color table according to an embodiment of a method for selecting color tables in an electrophotographic printing system in accordance with the present disclosure.

DETAILED DESCRIPTION

Figure 1:
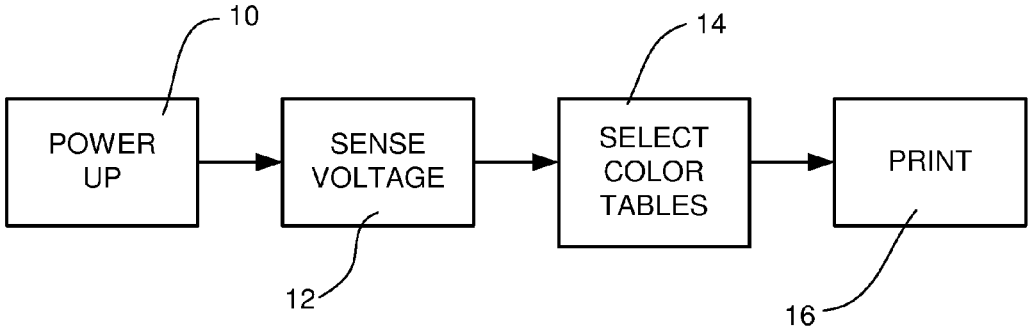
FIG. 1 is a flow chart outlining the steps in one embodiment of a method for selecting color tables in an electrophotographic printing system in accordance with the present disclosure.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

As used herein, the terms "toner" and "ink" are used interchangeably to refer to the pigment bearing medium that is affixed to print media in an electrophotographic printer, whether the medium is a liquid or solid (e.g. powdered toner) material.

As used herein, the term "ink level" refers to the total quantity of toner that is used to produce a given color.

As used herein, the term "color table" refers to a standard that defines the incremental proportions of given component colors of toner that are to be combined or mixed to obtain a desired print color. For example, to print a pure red image, equal portions of cyan and yellow toner are combined and fused to the print media.

The abbreviation CMYK refers to the component colors cyan (C), magenta (M), yellow (Y) and black (K), which are frequently used as component colors for toner.

The abbreviation RGB refers to the component colors red (R), green (G) and blue (B), which are frequently used as component colors in video images.

As noted above, the temperature of the fuser roller in a color electrophotographic printer has a significant effect on image quality. For best image quality and color saturation in color printing, it is generally desirable to provide maximum toner coverage on the page wherever needed. However, when printing documents, especially with high toner coverage and full color, the capacity of the fuser may be the limiting factor for the amount of toner that can be used. Too much toner, and/or a higher maximum ink level can result in incomplete fusing or paper jams. However, if the fuser is too hot for the amount of toner, paper offset or jams can be the result.

The inventors have found that the quality of a printed image is directly related to the line voltage provided to the printing unit because the line voltage is a direct limiter of fuser heat capacity, and thereby fusing capability. Line voltage can vary from place to place and from time to time. For example, standard electrical voltage can differ from country to country. Additionally, the voltage level in a given place can fluctuate over time, due to changing electrical supply and demand, and due to the age or other characteristics of the power distribution system.

One approach that has been attempted to deal with potential line voltage variations is to change the throughput of the printer system, so that the system will operate more slowly. Another approach is to optimize a printer's color tables for the lowest supported voltage. With this method, however, many users will experience reduced print quality unnecessarily. On the other hand, if color tables are optimized for higher voltages, then low voltage users may suffer decreased engine reliability and increased print quality defects.

Advantageously, the inventors have developed a method for selecting or optimizing color tables based upon line voltage without reducing throughput of the system. A flow chart outlining the steps in one embodiment of a method for selecting color tables in an electrophotographic printing system in accordance with the present disclosure is shown in FIG. 1, and a schematic diagram of a printing system employing this method is provided in FIG. 3. In this embodiment, the printing system is provided with a line voltage sensor (30 in FIG. 3). Referring to FIG. 1, when the printer is turned on, exits sleep mode or receives a job, (encompassed collectively in the "Power Up" block 10 of FIG. 1) the voltage is sensed (step 12). The detected voltage is then used to select the appropriate color table(s) (step 14), before the image(s) is/are printed.

The step of selecting the appropriate color table(s) (step 14) can include a variety of sub steps. First, the voltage that has been sensed can be defined into various ranges, depending upon the fusing capability of the system. For example, where the system is designed for 110v nominal power, the color table can be divided into three voltage regions, such as a low region corresponding to voltages in the range of 100v to 105v, a middle range corresponding to voltages from 105v to 110v, and a high range corresponding to 110v and up. The system can also have a minimum voltage threshold, below which the system will simply not operate due to insufficient power.

Each voltage range can have an optimized color table, stored in memory in the printer system, which defines the maximum ink level for each color for the fusing capability at that voltage. An example of a color table is provided in FIG. 5. This color table 50 is defined according to three different voltage ranges, labeled "Low", "Mid" and "High". Each voltage level corresponds to a maximum color table ink level, indicated in the second column of the table. In this example, it is assumed that the maximum fuser capacity for the printer system that is involved is 200%, meaning that in the high operating voltage range, the various component colors of toner can be applied in any combination that adds up to no more than 200%. At the low voltage level, however, only a 140% application is possible, meaning that component colors can be applied in a combination that adds up to 140% and no more, without potentially causing printing errors.

The different toner colors are applied in combination to create the final output colors based upon input colors. In many printers, all possible print colors are produced by different combinations of cyan (C), magenta (M), yellow (Y) and black (K) toner, referred to collectively as CMYK. For example, to produce red of various shades, varying proportions of magenta (M) and yellow (Y) toner are used. To produce green, cyan (C) and yellow (Y) are used. To produce blue, cyan (C) and magenta (M) are combined. To make a color darker, black (K) is added. To make it lighter, a lesser amount of each component color is used.

Some of these different combinations in each voltage range are indicated in the two rightmost columns of the chart of FIG. 5. As shown in the first row of the "Low" voltage color table, in the low voltage range, since the fuser capacity is only 140%, a pure red input color will be produced by the application of a 70% magenta (M) and 70% yellow (Y) combination. Similar proportions of cyan (C) and yellow (Y) will be used for green, as shown in the second line of the "Low" color table, and similar proportions of cyan (C) and magenta (M) will be used for blue, as shown in the second and third lines of the "Low" color table. However, where more than two component colors are required to produce the desired input color, the relative proportions of the components will be adjusted, so as not to exceed the maximum ink level. For example, as shown in the fourth line of the "Low" color table, if the color is to be a dark red, some proportion of black (K) toner will be required. Thus, to stay within the 140% maximum ink level for the low voltage range, the dark red can be comprised of 65% magenta (M), 65% yellow (Y), and 10% black (K).

A similar pattern is followed for the other color tables, though with different proportions of the component colors. The "Mid" color table has a fuser capacity of 170%. Consequently, as shown in the first line of the "Mid" color table, to produce pure red, 85% levels of Magenta (M) and yellow (Y) can be used. As indicated by the arrow 52 on the right side of the table of FIG. 5, the color saturation or image quality increases as the total ink level increases. Thus, the red that is produced based upon the "Mid" color table will be more intense because more of each toner color has been applied and fused to the print media. Similar proportions of cyan (C) and yellow (Y) will be used for green, as shown in the second line of the "Mid" color table, and similar proportions of cyan (C) and magenta (M) will be used for blue, as shown in the as shown in the second and third lines of the "Mid" color table.

Once again, where more than two component colors are required to produce the desired input color, the relative proportions of the components will be adjusted, so as not to exceed the maximum ink level. For example, as shown in the fourth line of the "Mid" color table, if the color is to be a dark green, some proportion of black (K) toner will be required. Thus, to stay within the 170% maximum ink level for the middle voltage range, the dark green can be comprised of 80% cyan (C), 80% yellow (Y), and 10% black (K).

A similar pattern prevails for the "High" color table, shown at the bottom of the table of FIG. 5. In this example, the "High" color table has a 200% maximum ink level. Where more than two component colors are required to produce the desired input color, the relative proportions of the components will be adjusted, so as not to exceed the maximum ink level. If the color is to be a dark blue while staying within the 200% maximum ink level, the dark blue can be comprised of 95% cyan (C), 95% magenta (M), and 10% black (K). Once again, as indicated by the arrow 52, the color saturation or image quality will be highest when based upon the color table of the "High" voltage range.

It is to be appreciated that the color tables shown in FIG. 5 are only exemplary and are extremely abbreviated. The number of voltage ranges and their boundaries are only exemplary. A color table selection method in accordance with this disclosure can have more than three or less than three voltage ranges. Moreover, the ink level ranges that are shown represent only a few of the simplest colors. Those of skill in the art will appreciate that a typical color printing system can print hundreds of different colors in varying shades throughout an entire color spectrum. For example, some printing systems are designed to print the colors that are part of the Pantone® color spectrum, though other color spectra can be used, and these can be complete or limited spectra. Consequently an actual color table that is prepared and stored in memory in accordance with the method disclosed herein is likely to have at least hundreds of entries, each providing a unique combination of toner proportions or levels for each of multiple colors of a large color spectrum.

Referring back to FIG. 1, in the "Select Color Tables" step the highest ink color table that can be properly fused at a given voltage level is selected by the printer system. For example, where the "Low" voltage range of FIG. 5 corresponds to voltages in the range of 100v to 105v, the "Mid" range corresponds to voltages from 105v to 110v, and the "High" range corresponds to voltages of 110v and up, if the sensed voltage is 110v, the system will select the "High" color table, and then printing can commence (step 16).

Figure 3:
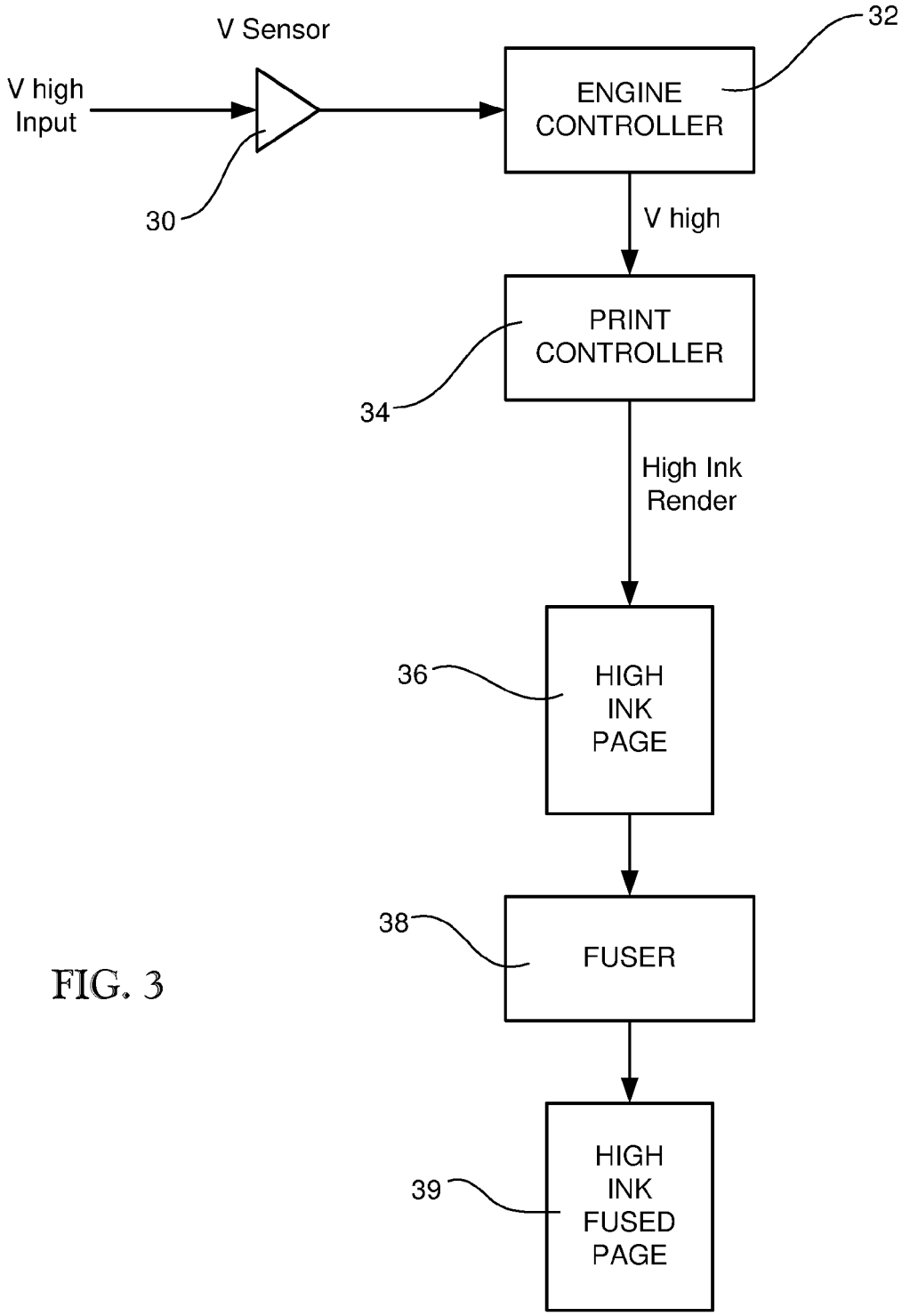
FIG. 3 is a schematic diagram of an electrophotographic printing system in which one embodiment of a method for selecting color tables in accordance with the present disclosure is implemented.

A schematic diagram of an electrophotographic printing system in which the method outlined in FIG. 1 can be implemented is shown in FIG. 3. This system includes a voltage sensor 30, which receives the input power and directly detects the line voltage. This detected voltage is communicated to the print engine controller 32, and thence to the print controller 34. The print controller selects the proper color table (in accordance with step 14 of FIG. 1, discussed above) for the printing job, and then renders the image using that color table. In the embodiment shown in FIG. 3, the input voltage is in the high range, and the print controller thus renders the image using the "High" color table. This involves the application of the ink or toner to the page within the printing system. The "High Ink Page" 36 then passes through the fuser 38, which produces the "High Ink Fused Page" 39, which is the finished product. Because the proper color table was selected based upon the sensed line voltage, the finished page will have approximately the best color saturation and image quality that can be achieved given the line voltage level, rather than a color saturation that might have been pre-selected as a compromise in view of possible voltage fluctuations.

Figure 2:
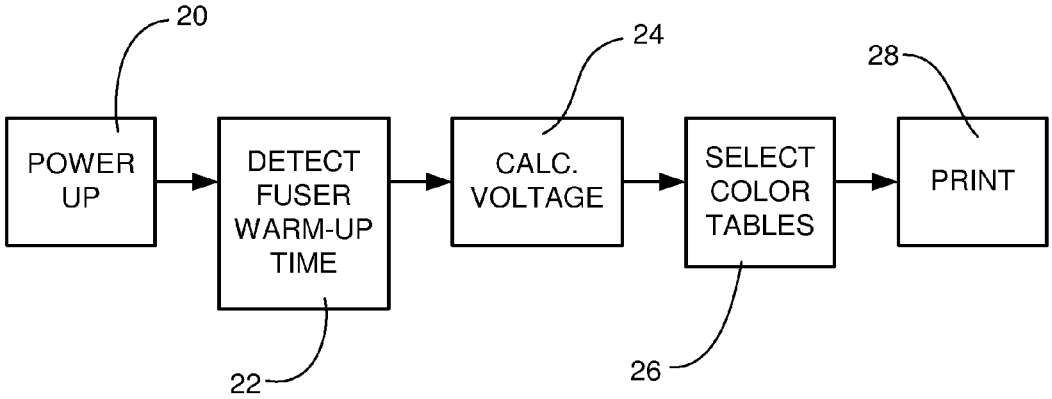
FIG. 2 is a flow chart outlining the steps in another embodiment of a method for selecting color tables in an electrophotographic printing system in accordance with the present disclosure.

Another embodiment of a color table selection method is outlined in the flow chart of FIG. 2. In this embodiment, no voltage sensor is used. Instead, the line voltage is determined based upon the fuser warm-up time. Electrophotographic printers normally include a temperature sensor in the fuser. As with the prior embodiment, whenever the fuser is powered from a cold or warm state to the appropriate "ready" temperature, that is, whenever the printer is turned on, exits sleep mode or receives a job, (encompassed collectively in the "Power Up" block 20 of FIG. 2), the amount of time required to reach the pre-determined "ready" temperature is measured (step 22). The warm-up time is a direct function of the line voltage: a higher voltage will produce a shorter warm-up time, and vice versa. Consequently, by measuring the warm-up time interval, the printer controller can determine or calculate the line voltage (step 24) and then select the highest ink color table (step 26) that can be properly fused, in the manner outlined above. The printer can then print the desired image(s) (step 28) without an increased likelihood of paper jams or print quality defects.

Figure 4:
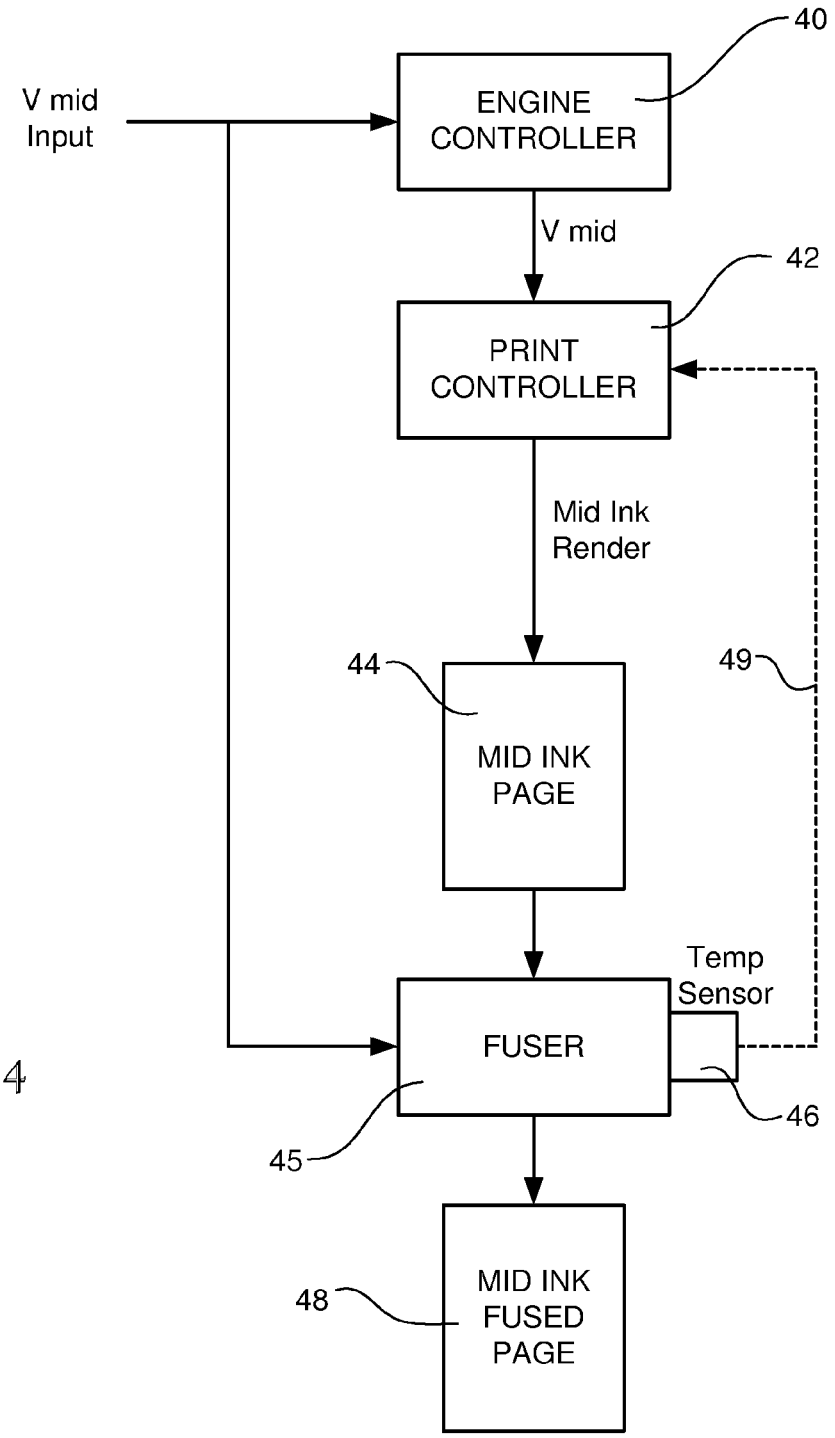
FIG. 4 is a schematic diagram of an electrophotographic printing system in which an alternative embodiment of a method for selecting color tables in accordance with the present disclosure is implemented.

A schematic diagram of a printer system employing the method embodiment of FIG. 2 is shown in FIG. 4. In this example, it is presumed that the input voltage is in what is defined as a "Mid" range. Again, the boundaries of the voltage ranges that are selected for preparing different color tables can be somewhat arbitrary, and any number of voltage ranges can be used in any given situation. The input voltage Vmid is provided to the print engine controller 40, and thence to the print controller, and is also provided to the fuser 45, to warm up the fuser to the proper fusing temperature. The temperature of the fuser is sensed by a temperature sensor 46, such as a thermistor, that is installed in the fuser. Feedback from the fuser temperature sensor, represented by dashed line 49, is provided to the print controller.

The print controller 42 is normally programmed to delay printing until the fuser 45 reaches its "ready" temperature, which is a particular temperature level. Where the voltage varies from the design voltage, the time required to reach this temperature will be increased. By measuring the time interval required for the fuser to reach the "ready" temperature, the print controller can calculate the actual line voltage. This allows the print controller to select an appropriate color table from among those stored in memory, and then print the document. For the system shown in FIG. 4, the print controller can select a "Mid" color table, and render the page using the toner values stored in that table, print the mid ink page 44, which is then fused by the fuser 45, producing the finished mid ink fused page 48.

There is thus disclosed a method for adjustment of color tables in color laser printing based upon fuser heat capacity. The method disclosed herein allows a system to adjust ink or toner levels based upon a determination or detection of line voltage. This allows the system to accommodate variations in line voltage while reducing the likelihood of print quality errors and paper jams. With this method, the very same image input will result in prints of different color saturation or image quality when printed at different voltages. However, the printing speed will not be affected. Consequently, most users will be able to benefit from higher maximum ink color tables (and thereby improved image quality) without reducing throughput (i.e number of pages per minute). Additionally, in the fuser warm-up embodiment (FIGS. 2, 4), no additional sensors are required to be added to the printer system.

The system and method thus allows utilization of the maximum ink level that is supported by each voltage, and the operation is automatic, without requiring user interaction. Given that the voltage determination is made at the "power up" stage, it is to be understood that this system accommodates relatively large scale voltage variations. That is, voltage variations that last for more than a few seconds. Short-term voltage fluctuations (e.g. lasting less than 1 s) are not likely to be detected by this method.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A method for color printing, comprising the steps of:

determining a voltage level of electrical power supplied to an electrophotographic printing device having multiple colors of toner, the voltage level defining a fusing capacity, wherein the fusing capacity defines a maximum amount of toner applicable to a given area, wherein a combination of the multiple colors of toner applied to the given area is less than or equal to the fusing capacity; and selecting a color table, stored in memory, defining a maximum toner application level for each color of toner, based upon the fusing capacity.

2. The method in accordance with claim 1, wherein the step of determining the voltage level further comprises directly sensing voltage of a power supply line of the electrophotographic printing device.

3. The method in accordance with claim 2, wherein directly sensing the voltage further comprises sensing voltage with a voltage sensor connected to the power supply line.

4. The method in accordance with claim 1, wherein the step of determining the voltage level further comprises detecting a warm-up time interval of a fuser of the electrophotographic printing device, and calculating the voltage as a function of the fuser warm-up time interval.

5. The method in accordance with claim 4, wherein detecting the warm-up time interval of the fuser comprises detecting fuser temperature, via a temperature sensor associated with the fuser, over the warm-up time interval terminated by the fuser reaching a pre-determined temperature.

6. The method in accordance with claim 1, wherein the step of selecting the color table further comprises classifying the line voltage into one of a plurality of voltage ranges, and selecting a color table corresponding to the one voltage range.

7. The method in accordance with claim 1, wherein the selected color table comprises a plurality of toner level values for multiple colors of toner for producing a plurality of image colors of a color spectrum.

8. The method in accordance with claim 1, further comprising the step of rendering an image to print using color values of the selected color table, and applying the toner to print media to produce the image.

9. The method in accordance with claim 8, further comprising the step of fusing the toner to the print media with a fuser of the printer device.

10. The method in accordance with claim 1, wherein the step of determining the voltage level is performed at a power-up time, the power-up time including any time that the printer device is turned on, exits a sleep mode, or receives a print job.

11. A system for printing, comprising:

an electrophotographic printer system, having a printer controller, and a fuser configured to fuse multiple colors of toner to print media at an elevated temperature;

means for determining a voltage of power provided to the printer system, wherein the power provided to the printer system corresponds to a maximum amount of toner applicable to a given area, wherein a combination of the multiple colors of toner applied to the given area is less than or equal to the maximum amount of toner applicable to the given area; and a plurality of color tables, stored in memory in the printer controller, the printer controller being configured to select a color table based upon the determined voltage.

12. The system in accordance with claim 11, wherein the means for determining the voltage is selected from the group consisting of a voltage sensor, coupled to the printer controller, and a fuser warm-up time detection system, associated with the printer controller.

13. The system in accordance with claim 12, wherein the fuser warm-up time detection system comprises a temperature sensor, associated with the fuser, configured to detect fuser temperature over a time interval terminated by the fuser reaching a pre-determined temperature, and to transmit the detected temperatures to the printer controller for calculation of the voltage as a function of the fuser warm-up time.

14. The system in accordance with claim 11, wherein each of the plurality of color tables comprises a plurality of toner level values for multiple colors of toner for producing a plurality of image colors of a color spectrum.

15. A non-transitory computer readable medium, comprising machine readable program code, for causing an electrophotographic printing device having multiple colors of toner to perform the steps of:

determining a voltage level of electrical power supplied to the printing device, the voltage level defining a fusing capacity, wherein the fusing capacity defines a maximum amount of toner applicable to a given area, wherein a combination of the multiple colors of toner applied to the given area is less than or equal to the fusing capacity; and selecting a color table, stored in memory, the color table defining a maximum toner application level for each color of toner, based upon the fusing capacity.

16. The non-transitory computer readable medium in accordance with claim 15, further comprising program code for determining the voltage level by receiving sensor output from a voltage sensor associated with a power supply line of the electrophotographic printing device.

17. The non-transitory computer readable medium in accordance with claim 15, further comprising program code for determining the voltage level by receiving signals representing a warm-up time interval of a fuser of the electrophotographic printing device, and calculating the voltage level as a function of the fuser warm-up time interval.

18. The non-transitory computer readable medium in accordance with claim 15, wherein the program code causes the printer to determine the voltage level at a power-up time, the power-up time including any time that the printer device is turned on, exits a sleep mode, or receives a print job.

19. The non-transitory computer readable medium in accordance with claim 15, further comprising program code for causing the printer device to select the color table by classifying the line voltage into one of a plurality of voltage ranges, and selecting a color table corresponding to the one voltage range.

20. The non-transitory computer readable medium in accordance with claim 15, further comprising program code for causing the printer to:

render an image to print using color values of the selected color table:

apply the toner to print media to produce the image; and fuse the toner to print media with a fuser of the printer device.

* * * * *